United States Patent [19]

Kihlström

[11] Patent Number: 5,000,623

[45] Date of Patent: Mar. 19, 1991

[54] DEVICE FOR HANDLING PIECE-FORMED PACKING MATERIAL

[75] Inventor: Christer Kihlström, Skara, Sweden

[73] Assignee: AB Lectrotechnic, Sweden

[21] Appl. No.: 402,824

[22] Filed: Sep. 5, 1989

[30] Foreign Application Priority Data

Sep. 5, 1988 [SE] Sweden ..... 8803097

[51] Int. Cl.[5] ..... B65G 53/28

[52] U.S. Cl. ..... 406/112; 406/153; 406/173

[58] Field of Search ..... 406/108, 109, 110, 112, 406/122, 127, 153, 154, 159, 164, 166, 168, 173, 176, 196

[56] References Cited

U.S. PATENT DOCUMENTS

| | | | |
|---|---|---|---|
| 1,471,927 | 10/1923 | Schutt et al. | 406/65 |
| 3,155,431 | 11/1964 | Baldwin | 406/153 |
| 3,239,278 | 3/1966 | Mueller et al. | 406/153 |
| 3,708,208 | 1/1973 | Fuss | 406/144 |
| 3,976,264 | 8/1976 | Ekama et al. | 406/112 |
| 4,249,839 | 2/1981 | Vance | 406/109 |
| 4,395,164 | 7/1983 | Beltrop et al. | 406/112 |
| 4,599,016 | 7/1986 | Medemblik | 406/173 |

FOREIGN PATENT DOCUMENTS

| | | | |
|---|---|---|---|
| 28086 | 5/1981 | European Pat. Off. . | |
| 3021089 | 12/1981 | Fed. Rep. of Germany . | |
| 560457 | 4/1957 | Italy | 406/109 |
| 1329555 | 9/1973 | United Kingdom . | |

*Primary Examiner*—Sherman D. Basinger
*Assistant Examiner*—Stephen P. Avila
*Attorney, Agent, or Firm*—Ostrolenk, Faber, Gerb & Soffen

[57] ABSTRACT

A device for handling piece-formed packing material, which incorporates a storage container (4) for the packing material, which at its lower side is equipped with a closable outlet (13), connected to a hose (6) for feeding out material, and at its upper end with an inlet (3) intended for supply of material, and connectable to a hose (6) for supply of material, and where the inlet (3) is provided with structure (11) for injecting a flow of air for lifting and supporting packing material in a direction towards the storage container (4).

7 Claims, 2 Drawing Sheets

DEVICE FOR HANDLING PIECE-FORMED PACKING MATERIAL

BACKGROUND OF THE INVENTION

In transport for packing of fragile goods it is used light, pieces of packing material of plastics, so called chips, which are when used surround the fragile goods in a cardboard box or the like. Handling of this material represents an inconvenience as the chips are used in large quantities and volumes, and the manual handling involves a circumstantial work.

PURPOSE AND MOST ESSENTIAL FEATURES OF THE INVENTION

According to the present invention it is now suggested a handling device by means of which filling as well as emptying and taking care of chips can be effected in a very work-saving and simple manner, and this has been achieved in that it comprises a storage container for the packing material, a closable outlet provided at the lower side of said storage container and connected to a hose for feeding out material from said container, an inlet for supply of material to the container provided at the upper end thereof, and being connectable to a hose, said inlet being provided with means for injecting a flow of air intended to lift and carry packing material in a direction towards the storage container.

DESCRIPTION OF DRAWINGS

The invention hereinafter will be further described with reference to an embodiment shown in the accompanying drawings.

DESCRIPTION OF EMBODIMENTS

Figure 1:
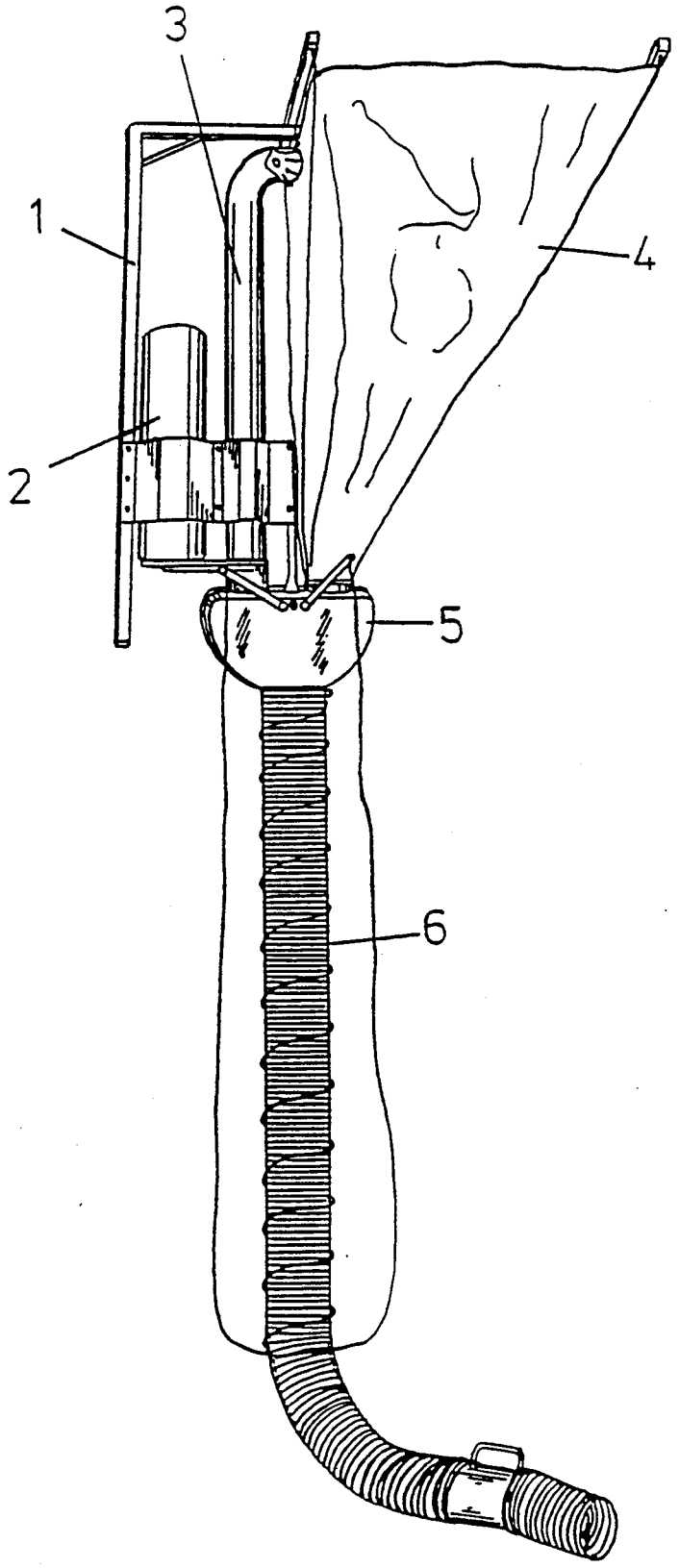
FIG. 1 shows a perspective view of the device according to the invention.

In FIG. 1 is shown a device for the purpose intended and incorporating a motor housing 2 suspended from a stand 1 and having a tubular channel 3 communicating with a storage bag 4 for chips and via a valve housing 5, to which the storage bag 4 is also connected, with a hose 6 for feeding out and for sucking up chips.

Figure 2:
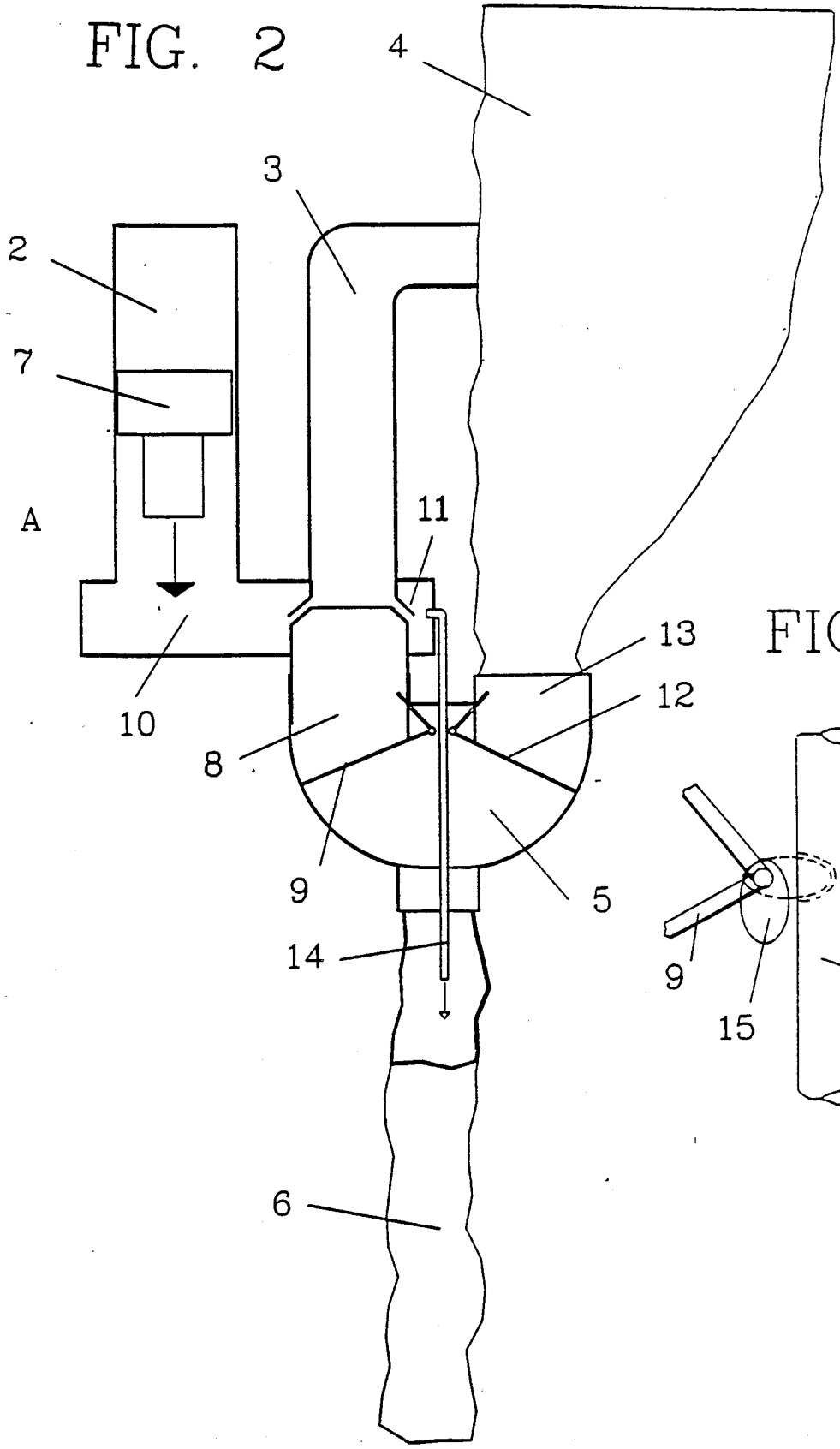
FIG. 2 is a schematic cross-section through the main parts of the device according to FIG. 1 in bigger scale.

FIG. 2 is a schematic cross-section through the device, from which can be seen that the motor housing 2 incorporates a fan motor 7, which delivers a flow of air in direction of arrow A.

In the valve housing 5 is provided a first valve 9, which in the position shown closes the end of a tube socket 8, which via a header 10 communicates with the motor housing 2. In this position air passes from the header through a slot 11 between the tube 3 and the upper end of the socket 8, which projects into the lower end of the tube 3. Due to the fact that the tissue of the bag is loose the air which via the tube 3 passes into the bag 4 will discharge through the fine openings of the bag. If the valve 9 is opened to the position shown in dash lines in FIG. 3, then air, which via the slot 11 flows into the tube 3, will eject air from the valve housing and from the hose 6 connected thereto, and when the end of the hose is lowered into a cardboard box among light chips, these will be sucked up via the hose 6, the valve housing 5, the tube socket 8, the tube 3 and will be introduced into the bag 4.

In the valve housing 5 is provided a further valve 12, which in the position shown closes a tube socket 13, situated below and in direct contact with the storage bag 4. When this valve is opened, chips in the bag 4 due to gravity will fall through the valve housing 5 and down into the hose 6, whereby a cardboard box can be filled in a simple manner.

In order to reduce the risk that chips shall remain in the hose 6 if this, e.g. is arranged horizontally, a hose 14 is connected to the header 10, which hose extends through the valve housing 5 and down into the hose 6, where it emits a small flow of air.

Figure 3:
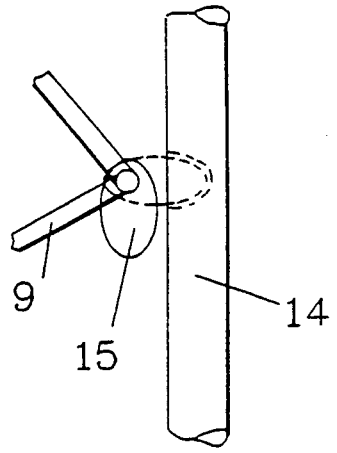
FIG. 3 shows in bigger scale schematically a detail solution in the device according to the invention.

In FIG. 3 is shown how the pivot shaft for the valve 9 is designed with an eccentric disc 15 adapted to restrict the flow of air through the hose 14 when the valve is opened, in order to prevent the flow of air from counter-acting the sucking up of the chips.

By the invention is obtained a simple and well operating device and due to the fact that the fan motor is separated from the material transport the risk for clogging of the motor part is avoided.

The invention is not limited to the embodiment shown in the drawing and described in connection thereto but modifications are possible within the scope of the appended claims.

What I claim is:

1. A device for handling piece-formed packing material, the device comprising:
   - a storage container for containing the packing material, the storage container having a lower side and an upper end;
   - a closable outlet and a hose for feeding the material out from the container, the closable outlet being located at the lower side of the storage container, the hose being connectable to the closable outlet;
   - an inlet for supplying the material into the container, the inlet being located at the upper end of the container, the inlet including flow causing means for causing a flow of air in the hose for lifting and carrying the material in a direction toward the container; and
   - a common valve housing with closing-off members, wherein the inlet and the outlet are connectable to the hose via the common valve housing, whereby the hose is used both for supplying the material into the container and for feeding the material out from the container.

2. The device of claim 1, wherein the flow causing means includes a header, an injection means and an air accelerator for delivering the flow of air.

3. The device of claim 2, wherein the injection means is constituted by a slot, the slot being limited by flanges which are directed obliquely toward the storage container.

4. The device of claim 2, further comprising a conduit which opens into the hose and which is connected to the header, wherein a first one of the closing-off members is adapted to close the inlet, wherein the conduit is adapted to blow air into the hose in a direction away from the valve housing when the inlet is closed by the first closing-off member.

5. The device of claim 4, further comprising a closing member for closing the conduit, the closing member being operatively connected to the first member such that the conduit is closed by the closing member when the inlet is open and such that the conduit is open when the inlet is closed by the first member.

6. The device of claim 2, wherein the storage container is a flexible, air penetratable bag-like member.

7. A device for handling piece-formed packing material, the device comprising, in combination, a stand, a storage container for containing the packing material, the container having an upper part and a bottom part, the container being suspended at its upper part from the stand, an inlet and an outlet being provided in the upper part and at the bottom part, respectively, of said storage container, first and second connecting conduits, a common valve housing provided at the lower part of the container, the common valve housing having an upper part and a lower end, said inlet and said outlet being connected via the first and second connecting conduits to the upper part of the common valve housing, the common valve housing having valve means for individually opening and closing said first and second connecting conduits, a hose connected to the lower end of said valve housing, an air accelerating means provided to introduce by injection in said first connecting conduit from the valve housing to the inlet a flow of air capable of lifting and carrying material through the hose, through the valve housing and through the first connecting conduit and via the inlet into said storage container.

* * * * *